US007488280B2

(12) United States Patent
Arsenault

(10) Patent No.: US 7,488,280 B2
(45) Date of Patent: Feb. 10, 2009

(54) METHOD AND APPARATUS FOR ABDOMINAL AND UPPER BODY STRENGTH TRAINING

(76) Inventor: Christopher Arsenault, P.O. Box 1724, Port Washington, NY (US) 11050

( * ) Notice: Subject to any disclaimer, the term of this patent is extended or adjusted under 35 U.S.C. 154(b) by 7 days.

(21) Appl. No.: 11/338,567

(22) Filed: Jan. 24, 2006

(65) Prior Publication Data

US 2006/0172868 A1 Aug. 3, 2006

Related U.S. Application Data

(60) Provisional application No. 60/647,861, filed on Jan. 27, 2005.

(51) Int. Cl.
*A63B 26/00* (2006.01)

(52) U.S. Cl. ..... 482/140; 482/148

(58) Field of Classification Search ..... 482/142, 482/907, 91, 140
See application file for complete search history.

(56) References Cited

U.S. PATENT DOCUMENTS 4,478,420 A * 10/1984 Sowards ..... 473/435
5,676,627 A * 10/1997 Howse ..... 482/97
6,280,367 B1 * 8/2001 Arsenault ..... 482/140
6,299,554 B1 * 10/2001 Sinclair et al. ..... 473/435

* cited by examiner

*Primary Examiner*—Lori Amerson

(57) ABSTRACT

An exercise device 12 is presented wherein a user 14 exercises the abdominal muscles and/upperbody strength training by throwing a ball 16 into a ball shoot 18 or against a rebound surface 20. The user 14 places back 22 on a horizontal fixed back rest portion 24 and buttocks 26 on a pivotal seat 28 and feet 30 on an adjustable device 32 provided for securing the feet. Springs 34 provides shock dissipation while the user 14 catches ball 16 in a downward position. The user 14 throws ball 16 in an upward movement into a ball shoot 18 retrieving ball 16 located at bottom ball ramp 36.

18 Claims, 13 Drawing Sheets

FIG. 5b
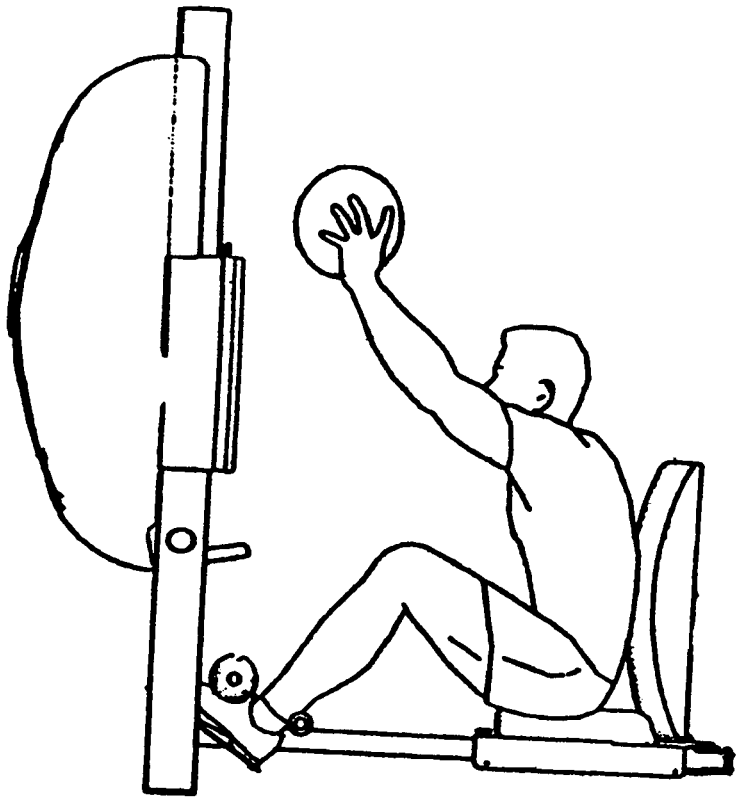
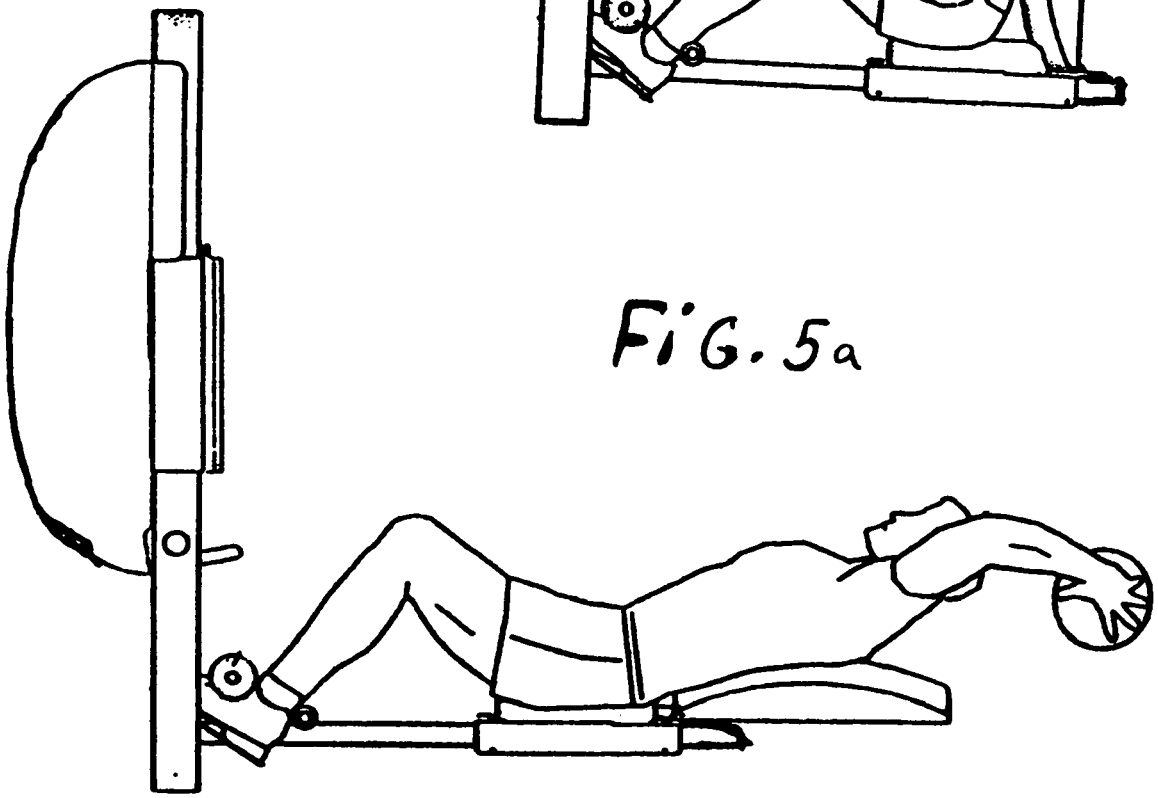
FIG. 5a

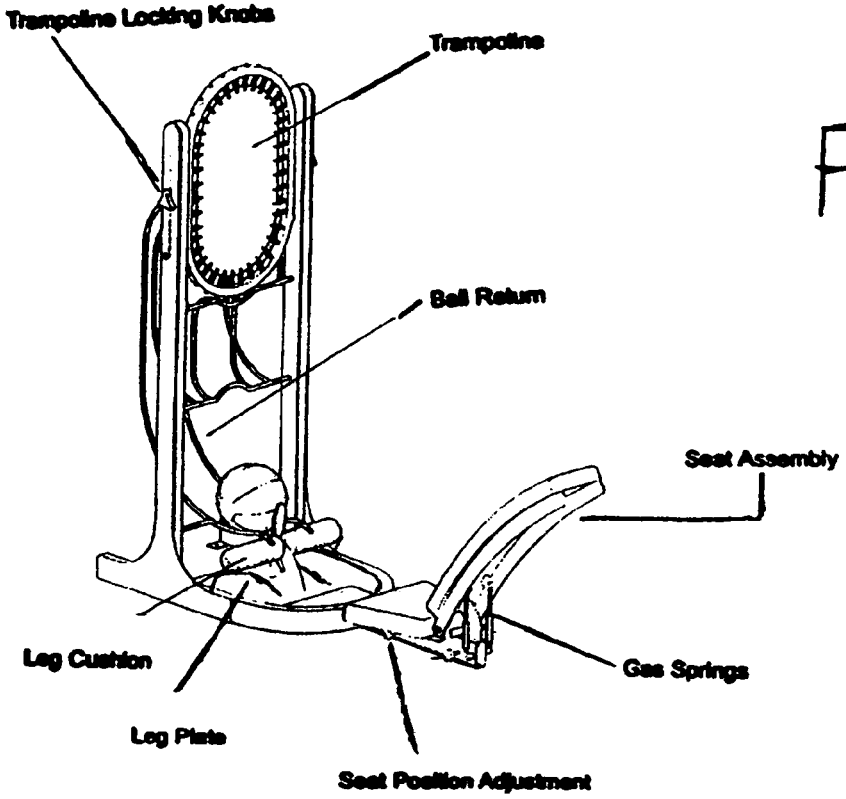
FIG. 13
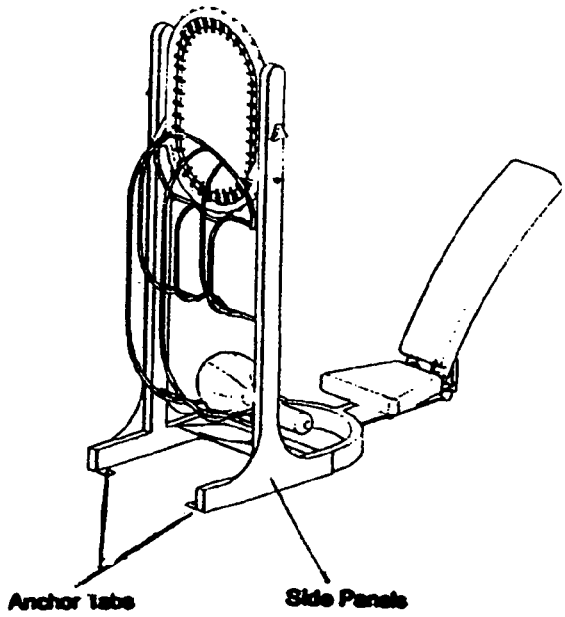

METHOD AND APPARATUS FOR ABDOMINAL AND UPPER BODY STRENGTH TRAINING

I am claiming this U.S. provisional application Ser. No. 60/647,861 Jan. 27, 2005 and please incorporate by reference all information is referenced provisional application into this instant application and there is no new matter.

BACKGROUND OF THE INVENTION

The present invention relates to a method and apparatus for strength training the upper body of a user, particularly the abdominal region, and more particularly to a method and apparatus which utilizes ball throwing and retrieving repetition to effect such strengthening of the abdominal and upper body muscles An apparatus has been previously suggested in U.S. Pat. No. 6,280,367 10 issued to Arsenault on Aug. 28, 2001, incorporated herein by reference for details relating to the general construction and functionality of an apparatus suitable for use in deflecting a ball thrown by a seated user in a direction back to the user, in which as disclosed therein, a user exercises the abdominal muscles by throwing a ball against a net system. As described therein, the user places his buttocks 15 and feet on a stationary platform (seat), and his head and back on a pivotable platform (backrest) which pivots about a hinge, spring biased in a raised position relative to the stationary platform. The spring provides lift assistance when the user throws the ball and shock dissipation when the user catches the ball. Foot straps are provided for securing the feet of the user. Nets are mounted 20 on supports, which are vertically adjustable. When used as intended, the user lies on his back upon the base platform with his feet secured within the foot straps located in the proximity of the deflection net. The user's feet and buttocks reside on the stationary portion of the base platform while his back and head are supported by the pivoting backrest which is at approximately a 45 degree angle to the floor and stationary portion The user begins the exercise by holding a ball and leaning back against the pivoting backrest to provide tension on the spring mechanism so he is propelled forward when he begins the sit-up. As the user is moving upward he throws the ball towards one of the deflection nets (i.e., center, right or left) depending upon which abdominal-muscle group is selected to be worked In accordance with the disclosure of the aforementioned prior art reference, the user attempts to time the throw so that the rebounding ball can be caught as he is heading back down to the reclined position where the tension spring provides resistance to dissipate impact and then reverses momentum to provide upward impetus for the next throw. While effective if performed properly, such timing may be difficult to achieve in practice for the novice or for individuals not in possession of sufficient muscle strength or coordination skills.

Therefore, it would be desirable to provide an apparatus which facilitates practicing a method in which a ball is repeatedly thrown and retrieved by a user for purposes of upper body strength training with particular emphasis on the abdominal muscle groups, and which is readily implemented by even the most inexperienced of individuals Accordingly, it is an object of the invention to provide a method and apparatus which overcomes the drawbacks of the prior art. It is a further object of the invention to provide a method and apparatus which allows a user to effectively and reliably strengthen many of the muscles of the upper body, particularly including the abdominal region, in a manner that is easy to implement even by the most inexperienced novice.

DESCRIPTION OF THE PRIOR ART

Inventor: Arsenault; Christopher (P.O. Box 1724, Port Washington, N.Y. 11050) U.S. Pat. No. 6,280,367 filed: Mar. 20, 2000.

A ball return apparatus for exercising abdominal muscles, more specifically, a ball return apparatus with a pivoting bi-sectional spring loaded base platform to hip propel the user from a reclined position to a sitting position as he throws a weighted ball towards an elevated ball deflection net that is connected to the stationary portion of a base platform by means of a releasable high-tension mechanical stabilizing spring. A similar spring connects the stationary and pivoting portions of the base platform to provide lift when the user is on the upswing and shock dissipation when reclining. The present invention incorporates skill and gamesmanship into abdominal exercises so as to provide full and interesting way for the user to get a complete abdominal workout.

There are other ball return devices designed for returning balls while exercising. Typical of these is U.S. Pat. No. 5,039,109 issued to Kenneth J. Mahoney et al. On Aug. 13, 1991

Another patent was issued to Andrew Cacvso on Feb. 15, 1994 as U.S. Pat. No. 5,286,020. Yet another U.S. Pat. No. 5,580,048 was issued to Kerry D. Mullen et al. On Dec. 3, 1996. Another was issued on Mar. 25, 1997 to Hua-Lu Hsiang as U.S. Pat. No. 5,613,922 and still yet another was issued to Ronald A. Anderson et al. On Jun. 30, 1998 as U.S. Pat. No. 5,772,537.

U.S. Pat. No. 5,039,109

Inventor: Kenneth J. Mahonev et al

Issued: Aug. 13, 1991

The portable mounting stand apparatus of this invention is adapted to receive a ball return apparatus for the like thereon and provide means for ease of movement from a portable transport condition to a rigid usage condition. The portable mounting stand apparatus includes a main support base assembly; a forward base support assembly secured to a forward portion of the main support base assembly; and a rearward base support assembly connected to a rear portion of the main support base assembly. The forward and rearward base support assemblies are each provided with support wheel assemblies to contact a support surface for ease of mobility in the transport position.

Inventor

Inventor: Kerry D Mullen et al

Issued: Dec. 3, 1996

A modular return apparatus for reflecting back an object such as a ball or a puck when struck by the ball or puck traveling on a playing surface, for use in returning the ball or puck to the player for another shot and in training the player to shoot the ball or puck accurately and anticipate the anode of reflection and velocity of the puck or ball comprises an elongated reflecting bumper a pair of supports for the reflecting bumper, and a rod for connecting the supports to each other and preventing their relative motion. A net may be attached to the return apparatus to catch the puck U.S. Pat. No. 5,613,922

Inventor: Hua-Lu Hsiang

Issued: Mar. 25, 1997

A multipurpose athletic training apparatus including a trampoline, two fastening devices for fastening the trampoline to the stands, the fastening devices being adjustable to fix the trampoline to between a horizontal position in which the trampoline is used as a table, and a titled position in which the trampoline is used as a rebound apparatus for rebounding balls thrown against it, a handrail for fastening to the stands at the top, and two net posts for fastening to the stands for stretching the net for the game of badminton U.S. Pat. No. 5,772,537

Inventor: Ronald A. Anderson et al

Issued: Jun. 30, 1998

A ball return device that enables a user to quickly and easily adjust the force with which a ball thrown into the device is returned. The ball return device includes a frame constructed from sections of plastic tubing joined by 90-degree elbows, forming a base and an elevatable portion. The elevatable portion of the frame is pivotally mounted to the base and adjustably positioned at a desired angle relative to the generally horizontal base by a pair of support members. The angle of the elevatable portion of the frame to the base determines the direction in which the ball is returned relative to a given incident path.

SUMMARY OF THE INVENTION

In accordance with these and other objects of the invention, there is provided a method and apparatus in accordance with which, a user wishing to increase upper body strength repeatedly throws and retrieves one or more balls in repetitive sequence while altering a body posture. A ball held by the user is thrown while a torso of the user is flexed at the waist from a reclined position to a sitting position A normal trajectory of the thrown ball is altered by suitable means to a redirected trajectory which returns the ball to a suitable position for retrieval by the user. The nature (speed, etc) and path of the redirected trajectory is advantageously selectable by alteration of physical characteristics of the apparatus according to the invention, such that a degree of difficulty in the retrieval process can be selected dependant upon the experience and desires of the user. As used herein, the term "trajectory" is defined as broadly embracing any path (locus) of travel of an object in motion, and includes objects in contact with a physical contact surface or guide-way, as well as freely flying objects traveling through open space acted upon by the influence of gravity.

In accordance with an embodiment of the invention, an apparatus includes a hinged seat, biased in a seat-back upright (or partially upright) position on which the user sits such that a reclined and sitting posture can be assumed during performance of the intended exercise described below herein. A foot restraint is advantageously provided suitably located to facilitate the sitting up process for the user A ball return guide is positioned in front of the seated user, and includes a structural configuration which redirects a normal trajectory of the ball when thrown into the ball return guide, causing the all to instead assume a redirected trajectory along which the ball travels to a location below a position of entry when throwing, for subsequent retrieval by the user.

In accordance with an advantageous embodiment, the ball return guide is configured as an areuate track or channel presenting a continuously curved back surface extending from a top end to a bottom end, such that when the ball is thrown into the top end (upper portion) of the arcuate track the ball is roughly guided by the curvature of the back surface and is directed to the bottom end (lower portion) where it is retrieved The arcuate track (channel) advantageously includes enclosed sides to prevent the ball from jumping out laterally while following the back curvature. Still more advantageously, the sides are wider apart at the top end of the channel to allow for a greater margin of error in aiming when the ball is thrown by the user.

In a particularly advantageous embodiment, an apparatus as described generally above optionally includes a structural adaptation allowing the user to select two modes of operation, each of the modes redirecting the ball in a particular manner different from the other For example, the user can operate the apparatus in the manner described above, wherein the ball in thrown into upper portion of the channel and returned at a lower portion where the user retrieves it. Alternatively, a more advanced user can optionally select a mode whereby the ball is rebounded directly back to the user off of a suitable rebound surface, such as a hard or elastically tensioned flat and widened member. To achieve these objects, the apparatus advantageously includes a rebound member presenting a rebound surface against which the ball can be thrown, which can be alternately positioned between a position blocking the opening at the upper portion of the channel and another position in which the rebound member does not obstruct the ball reception opening in the upper portion of the channel in the ball return guide A further option includes a structural feature permitting a third mode of exercise, and in which a baffle is suitably positioned inside the channel of the ball return guide below the upper portion thereof through which the ball is thrown, such that once initially redirected, the ball is slowed by impact with the baffle during its downward descent sufficiently that it can be effectively stopped and retained within the channel at the lower portion thereof when it reaches a stop (or low wall) provided at the front edge of the lower portion of the channel. Such feature provides the optional advantage of permitting use of more than one ball, a benefit being that there will always be a ball available for a subsequent throw already resting at the bottom of the channel from a previous throw.

A method of exercising practiced in accordance with an embodiment of the invention broadly includes the steps of holding a ball while assuming a reclined position;

whereby the ball is rebounded directly back to the user off of a suitable rebound surface, such as a hard or elastically tensioned flat and widened member. To achieve these objects, the apparatus advantageously includes a rebound member presenting a rebound surface against which the ball can be thrown, which can be alternately positioned between a position blocking the opening at the upper portion of the channel and another position in which the rebound member does not obstruct the ball reception opening in the upper portion of the channel in the ball return guide.

A further option includes a structural feature permitting a third mode of exercise, and in which a baffle is suitably positioned inside the channel of the ball return guide below the upper portion thereof through which the ball is thrown, such that once initially redirected, the ball is slowed by impact with the baffle during its downward descent sufficiently that it can be effectively stopped and retained within the channel at the lower portion thereof when it reaches a stop (or low wall) provided at the front edge of the lower portion of the channel. Such feature provides the optional advantage of permitting use of more than one ball, a benefit being that there will always be a ball available for a subsequent throw already resting at the bottom of the channel from a previous throw.

A method of exercising practiced in accordance with an embodiment of the invention broadly includes the steps of holding a ball while assuming a reclined position;

throwing a ball in a forward arc while sitting up such that the ball follows a normal trajectory; and directing the ball from the normal trajectory to a redirected trajectory along which the ball travels from an initially redirected position to a retrieval position below the initially redirected position.

These steps may advantageously be repeated a desired number of times to achieve a desired effect on the muscles of the abdomen and upper body.

The above, and other objects, features and advantages of the present invention will become apparent from the following description read in conjunction with the accompanying drawings.

BRIEF DESCRIPTION OF THE DRAWINGS

FIGS. 5*a* and 5*b* depicting respective steps performed in the course of a method according to an embodiment of the invention;

FIGS. 9, 10*a*, 10*b*, and FIGS. 11, 12, and 13 are two alternative embodiments to serve as illustration of just some of the changes that could be made to the embodiments without departure from the invention.

DETAILED DESCRIPTION OF THE PREFERRED EMBODIMENT

Figure 1:
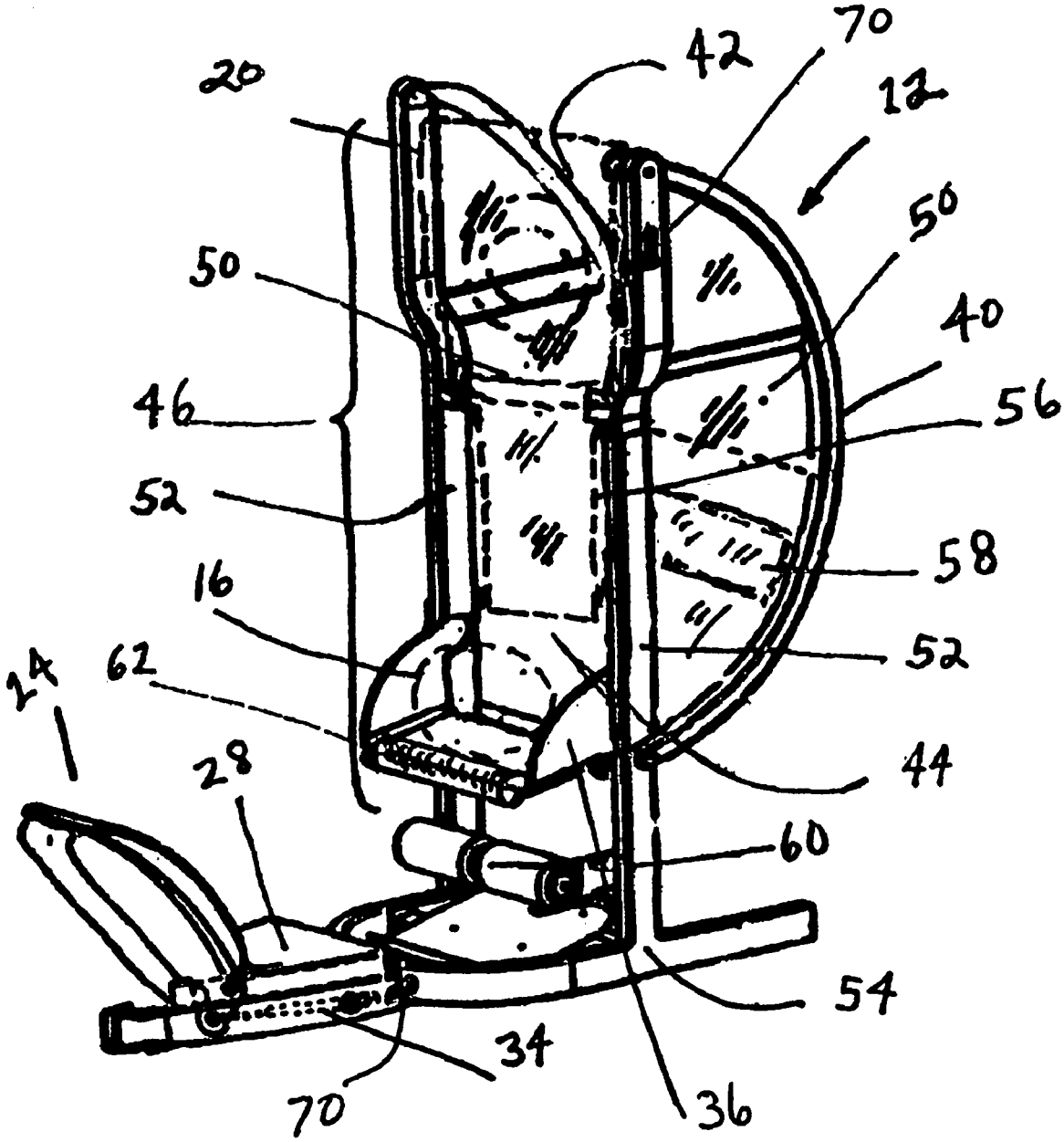
FIG. 1 is a perspective view of an apparatus in accordance with an embodiment of the invention.
Figure 2:
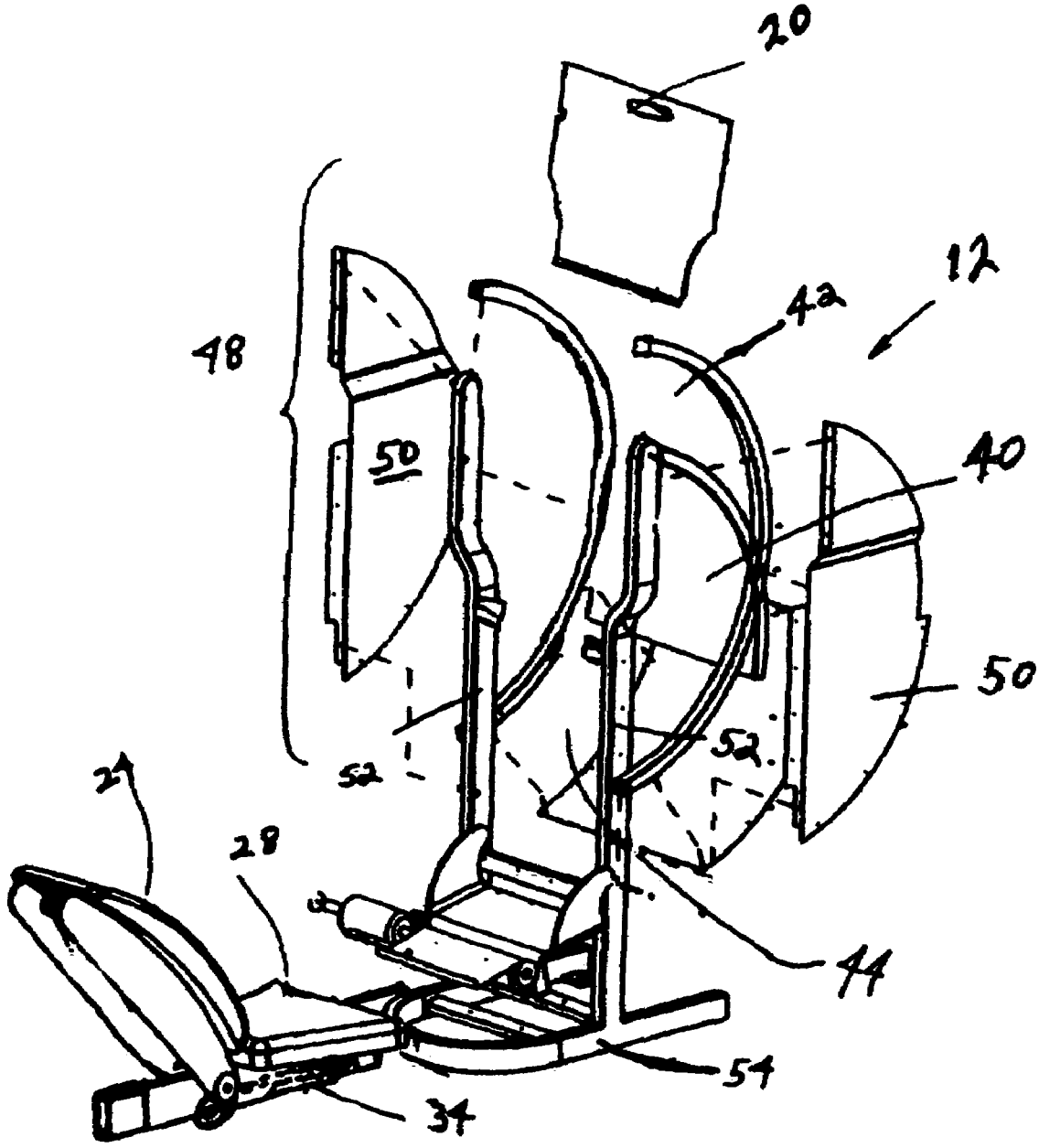
FIG. 2 is an exploded view of the embodiment of FIG. 1.
Figure 3:
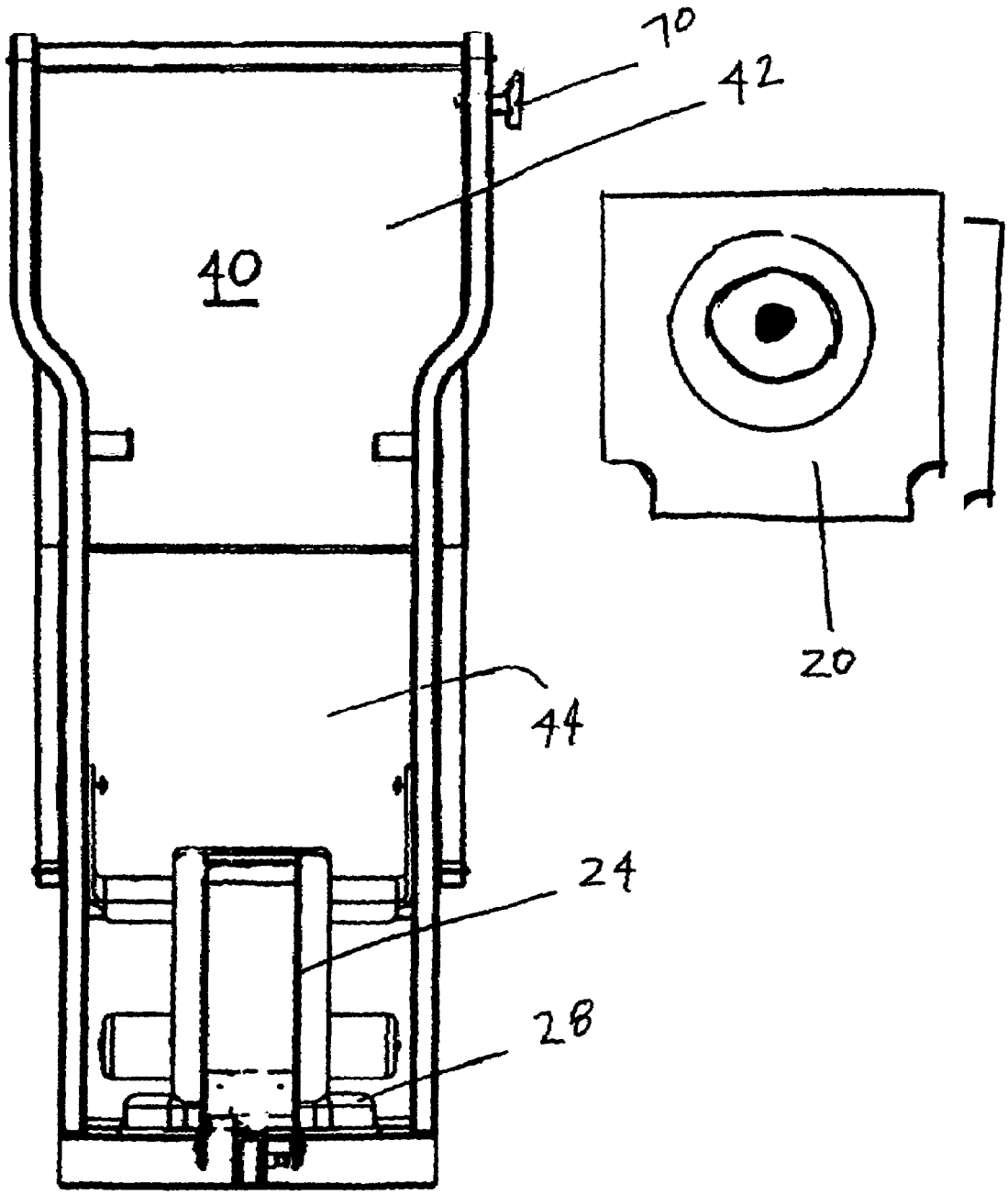
FIG. 3 is an elevational rear view of the embodiment of FIG. 1 facing a ball return guide at which a ball will be thrown during use.

Referring now to FIGS. 1-8, an embodiment of the exercise apparatus is shown, generally designated 12. Apparatus 12 includes a seat 28 comprised of a horizontal portion 24 from at least partially upright position to an at least partially reclining position, respectively, during performance of the intended exercise. Forward of the seat 28 there is provided a ball return 48 which, in the depicted example, is in the form of a channel presenting a continuously cured back portion 40 extending from the upper portion 42 to a lower portion 44, such that when a ball 16 is thrown into the upper portion 42 of the accurate ball return guild 46 the ball is roughly guided by the curvature of the surface of the back portion 40 and is directed to the lower portion 44 where it is retrieved by the user during use. The ball return guild 48 advantageously includes enclosed sides 50 to prevent the ball from jumping out laterally while following the back curvature. Still more advantageously, the sides 50 are wider apart in the region of the upper portion 42 of the channel shaped ball return guild 46, as shown, to allow for greater margin of error high aiming when the ball is thrown by the user A pair of bilateral vertical supports 52 and a base 54 conveniently maintain the ball return guild 48 in a fixed position. Since the ball traveling along the redirected trajectory while in the ball return guild 46 will be redirected by the ball damper 58, (Shown in phantom in FIGS. 1, and -4) to 48 propel into the ball baffle 56, (Also shown in phantom in FIGS. 1-4) slowing it down to the lower portion 44, 36 and 36 for the user to retrieve. Still more advantageously, particularly when the ball 16 is thrown into upper portion 42 and ball return guild 46 and selectively installed in the channel of the ball return guild 46 a ball damper 58 and ball baffle 56 for the purpose of slowing the ball down to allow time for the user to retrieve the other ball Optionally, a rebound member 20 is also provided (Shown in FIG. 2, 3 and in phantom in FIG. 1) Rebound member optionally has a target or bulls eye disposing centrally, as depicted in FIG. 3 for the improved sight recognition by the user when aiming which can be moved from a position in which it blocks the front opening to the upper portion 42 of the ball return guild 46 to another position in which the rebound member 20 no longer obstructs the opening, for example, the user would simply pull on pull pin 70 releasing the rebound member 20 exposing upper portion 42.

Figure 4:
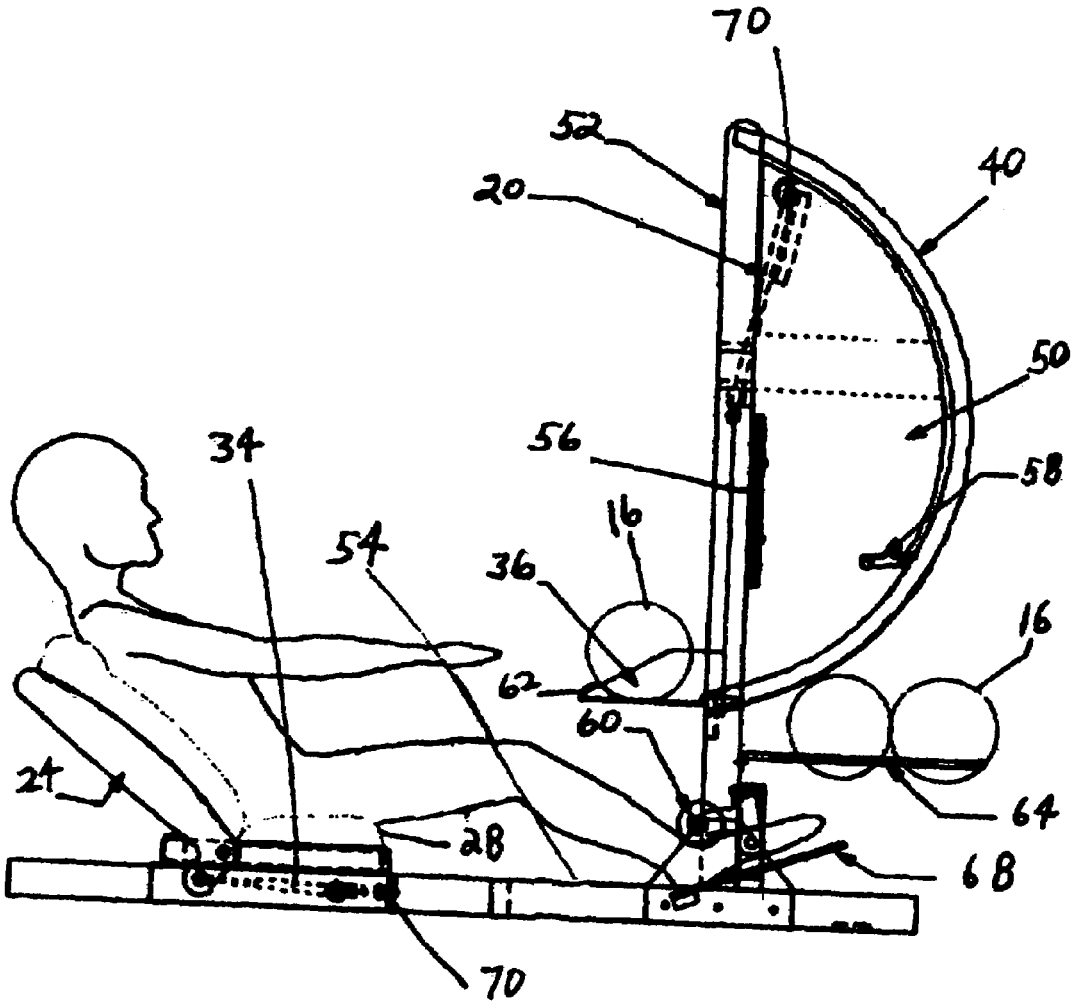
FIG. 4 is a side detail view of the embodiment of FIG. 1, which a user will be throwing during use.
Figure 6:
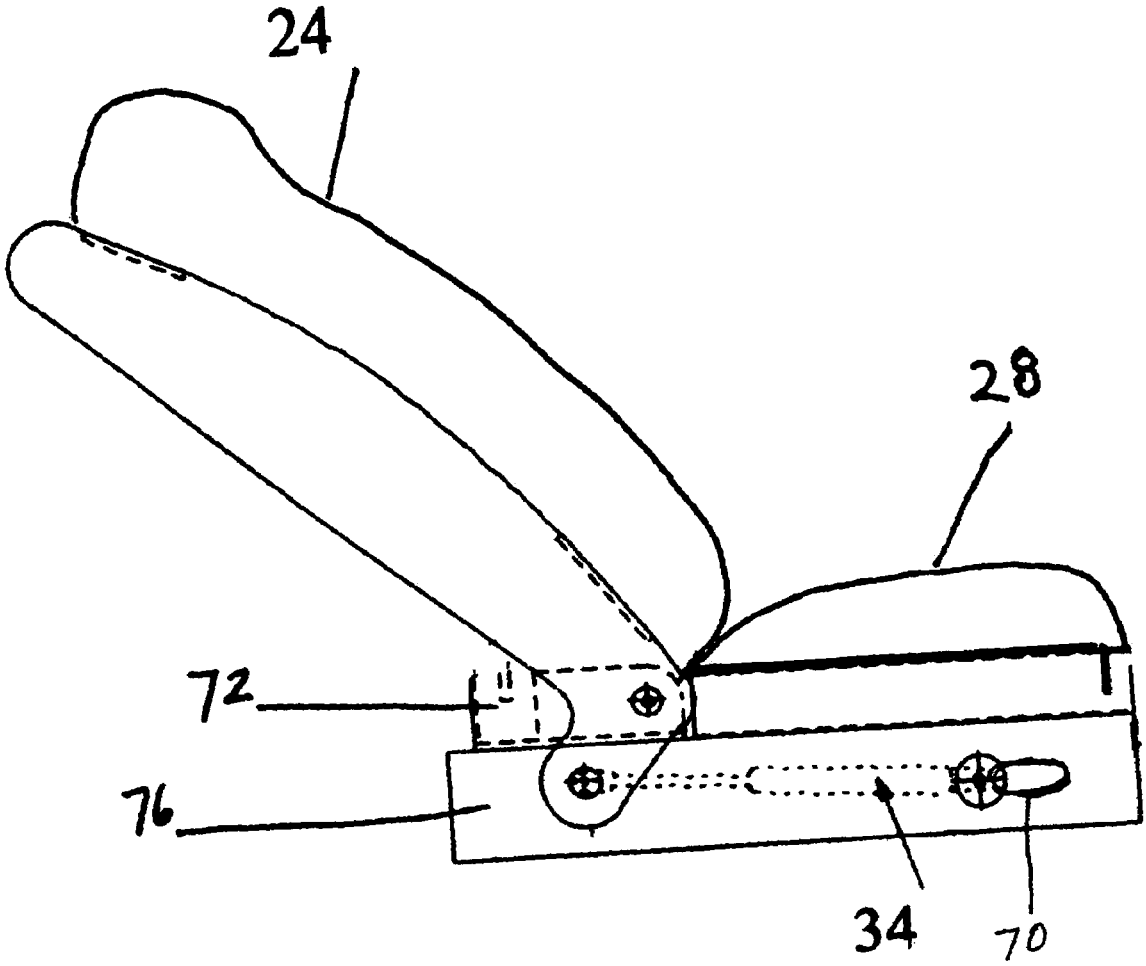
FIG. 6 is an annotated detail view of a seat construction according to an advantageous embodiment.
Figure 7:
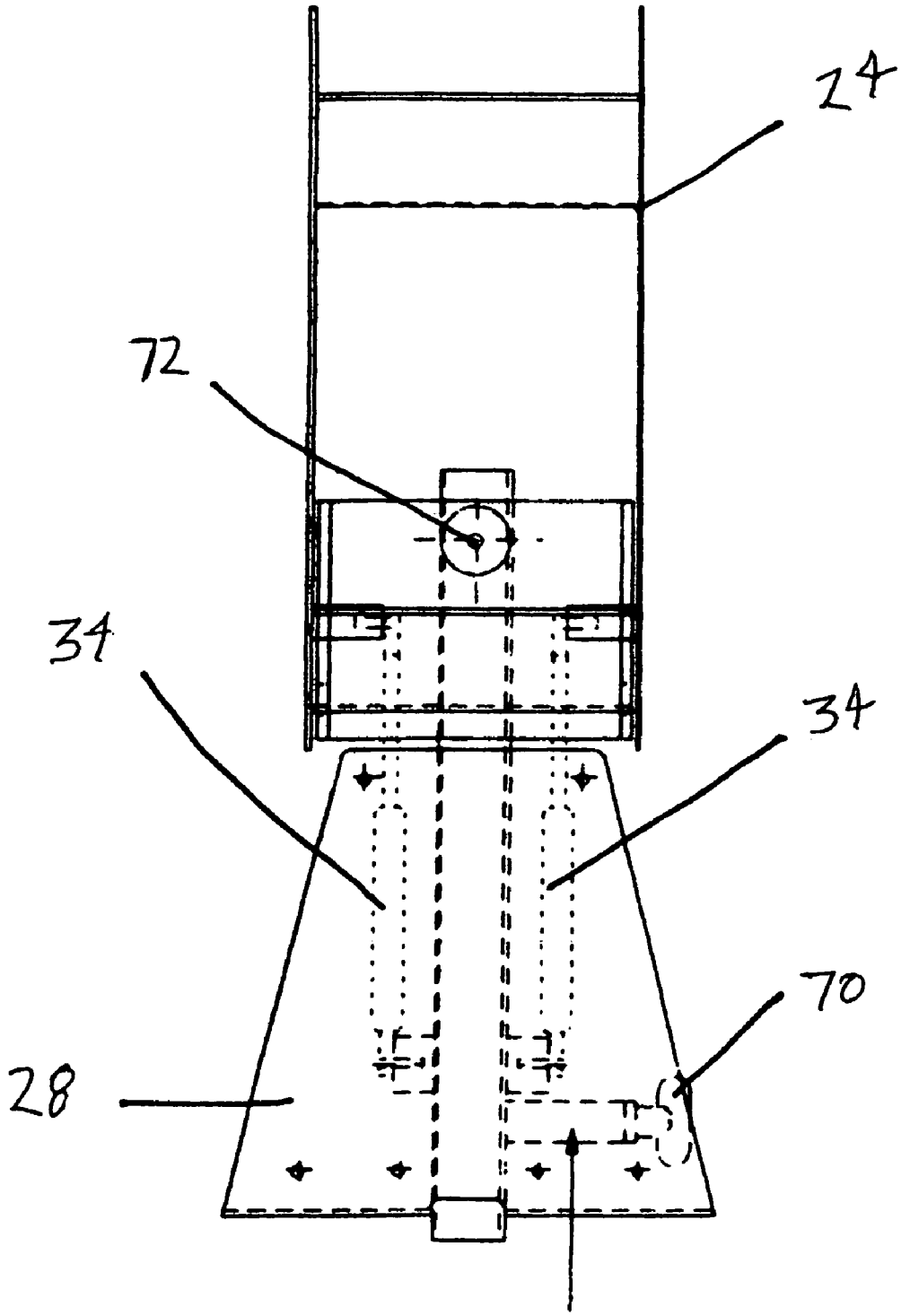
FIG. 7 is an annotated detailed rear view of a seat construction of the embodiment of FIG. 6
Figure 8:
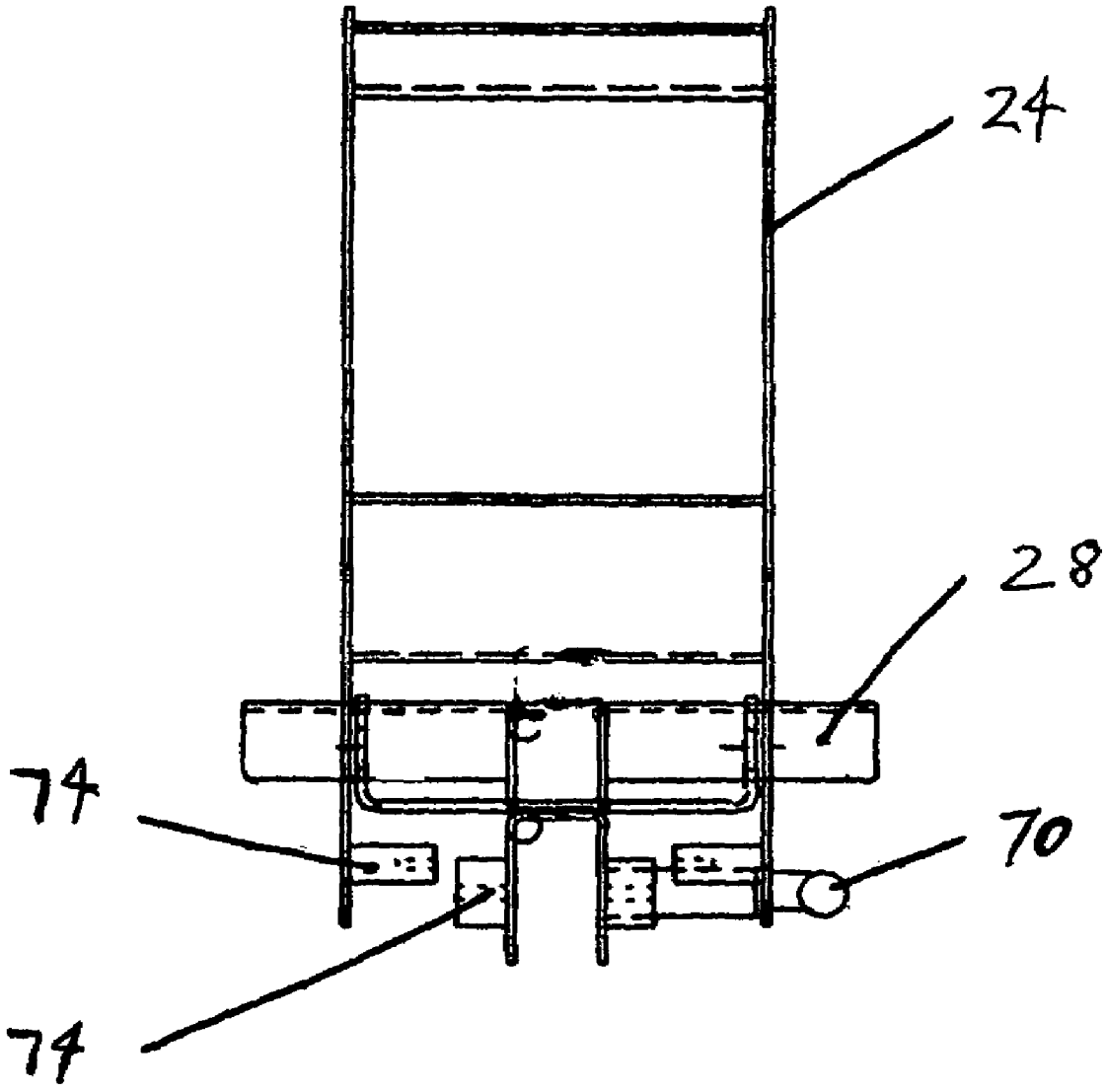
FIG. 8 is an annotated detailed rear view of the seat construction of the embodiment of FIG. 6
Figure 9:
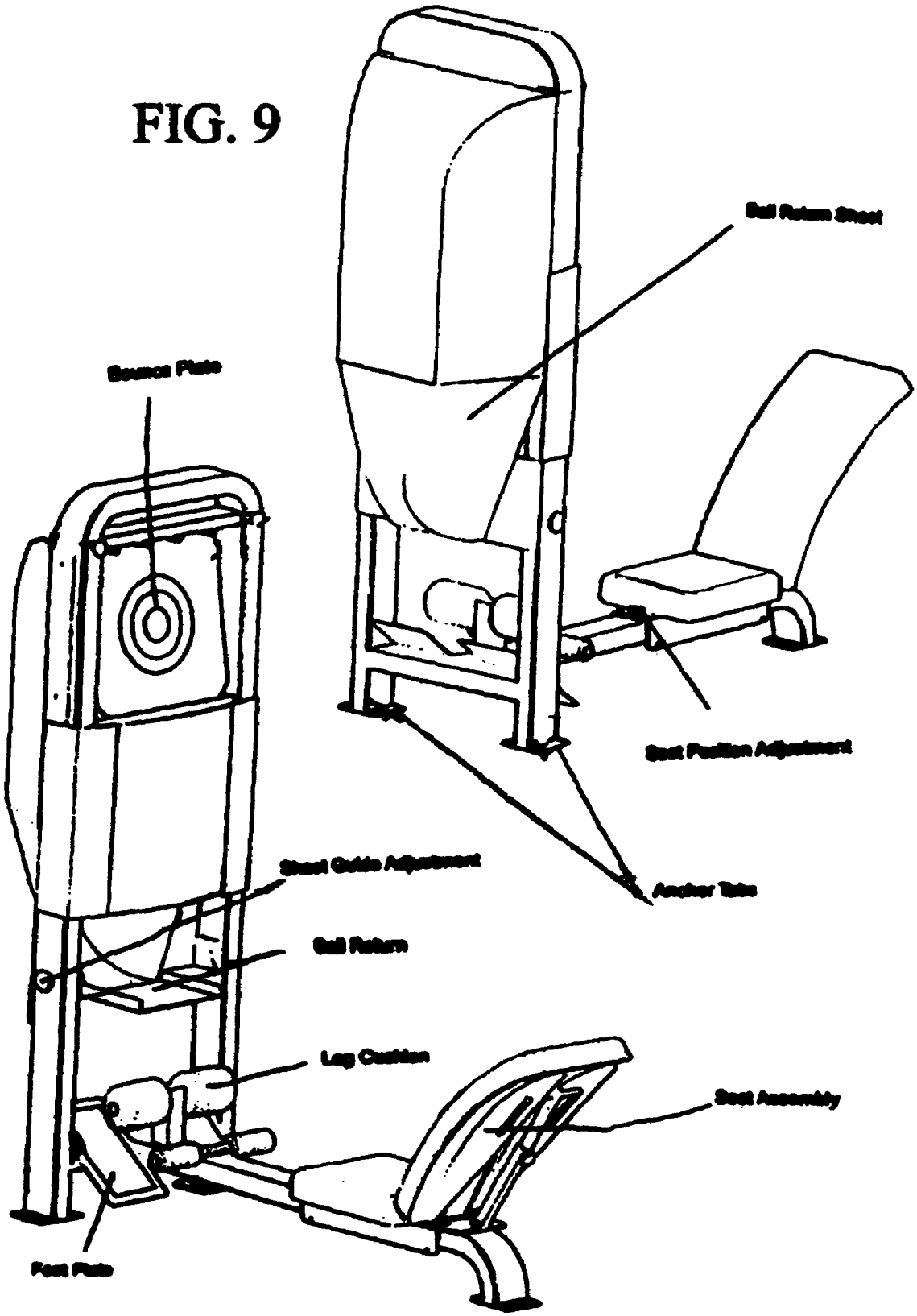
Figure 10A:
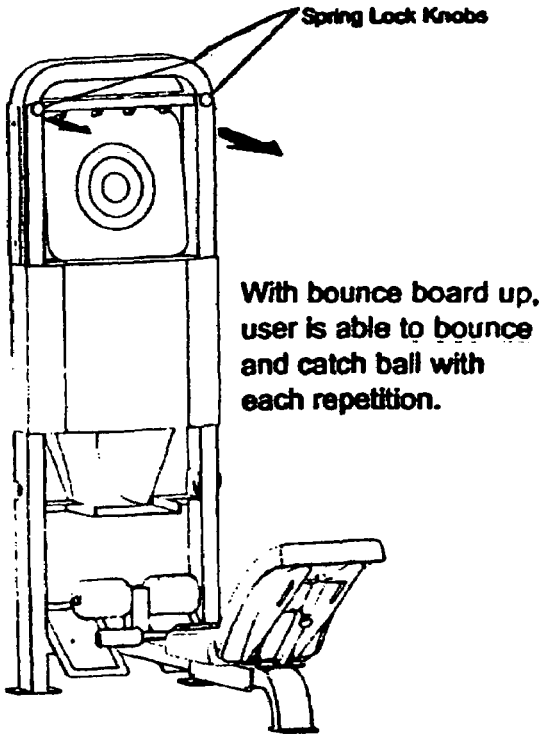
Figure 10B:
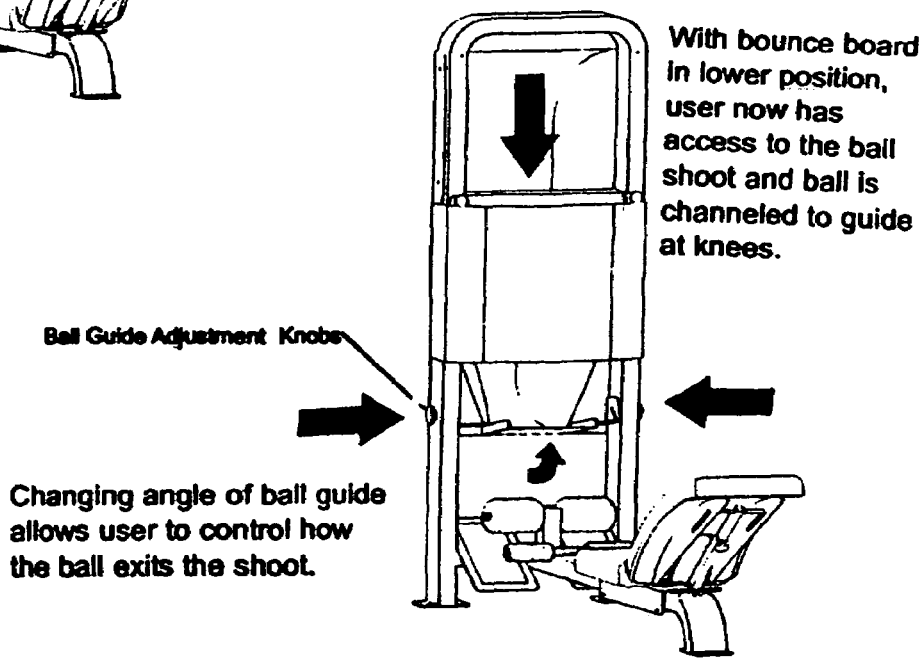
Figure 11:
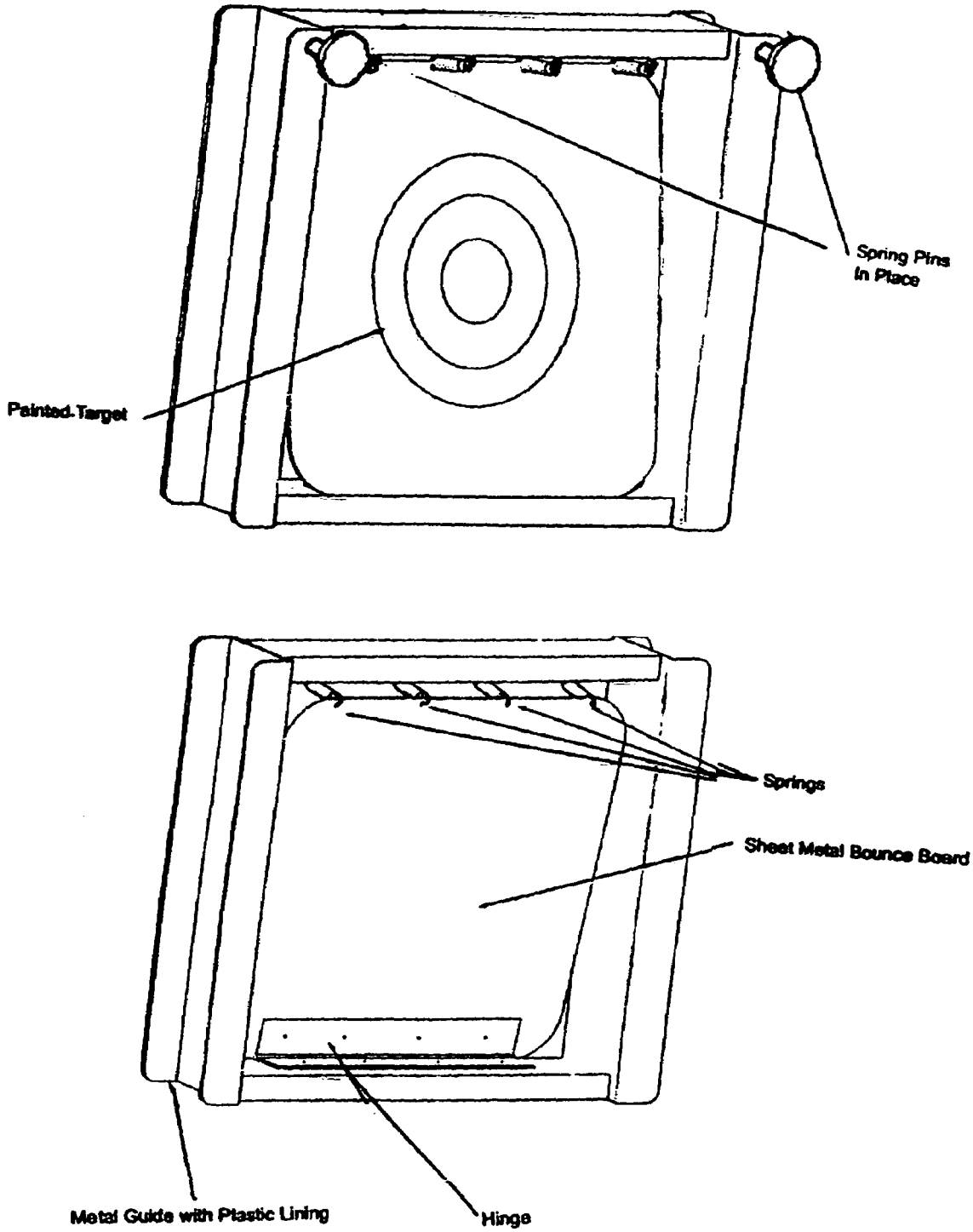
Figure 12:
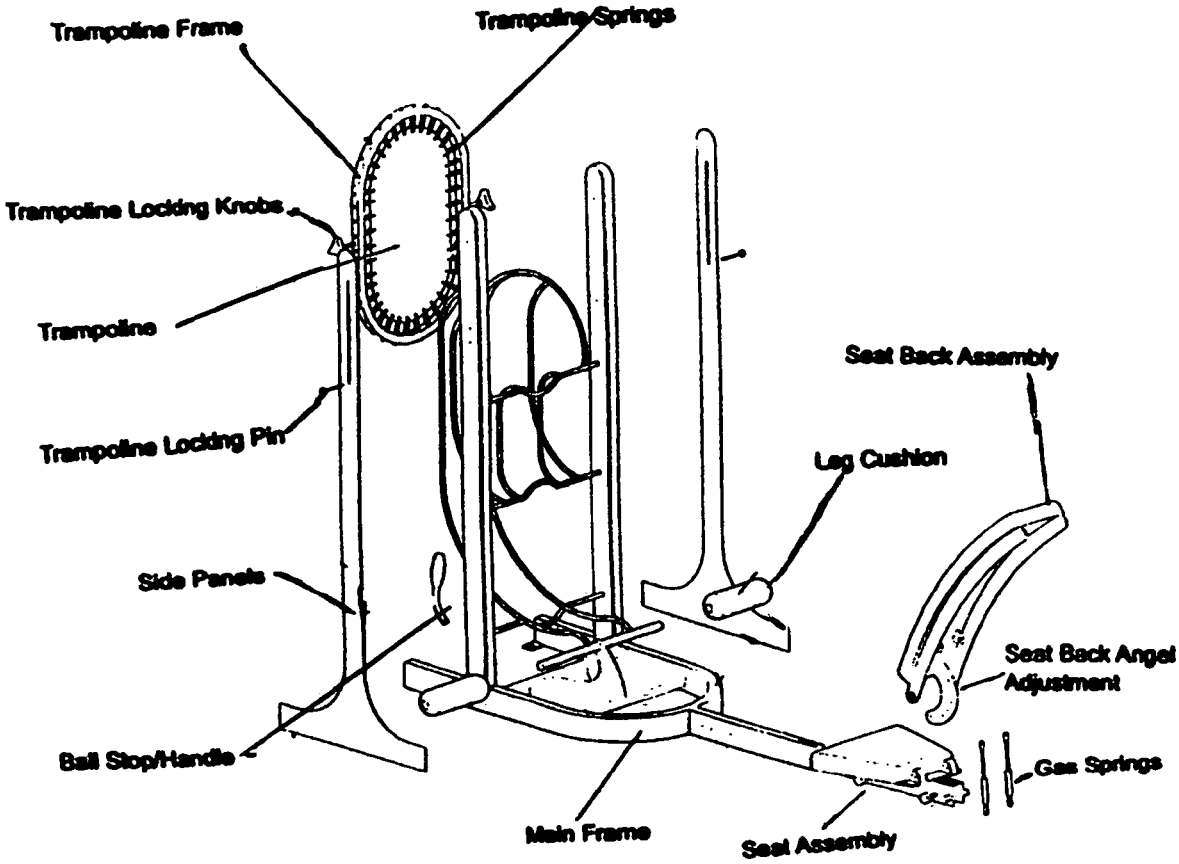

As shown in FIGS. 6, 7 and 8 in which the details of the seat 28 are highlighted, the backrest 24 is biased by springs 34 connected to the main frame seat 76 in an at least partially upright position. Other features of the seat 28 are annotated on the drawing sheet containing FIG. 4. During use, as shown in FIGS. 5*a* and 5*b*, the seat 28 is oriented alternately in brought back to a reclined position after ball retrieval and before a subsequent thro (FIG. 5*a*) and to an upright (or partially upright) position while throwing the ball (FIG. 5*b*) A foot restraint 60, (as shown in FIG. 4) is also advantageously provided suitably located to facilitate the sitting up process for the user.

The functionality of the apparatus and the various elements have been descried above, and therefore further description is believed to be unnecessarily redundant.

It will be readily apparent to one of ordinary skill in the art that a vast number of different structural configurations can achieve the desired effect within the broad parameters of the inventions described herein. For example, a different manner of support can be implemented, and the apparatus need not be integrated, and instead be provided as separate modules. Also, by way of example, the ball return guild need not be fully enclosed, but instead be provided as an open cage Furthermore, the rebound member, provided in the depicted embodiment as a rigid plastic or metal part could also be a tensioned resilient substance, such as a mesh or elastic member To serve as illustration of just some of the changes that could be made to the above described embodiment without departure from the invention, two alternative embodiments are shown in FIGS. 9, 10*a*, 10*b*, 11, and FIGS. 12, 13, respectively These figures are annotated with descriptions relating to the design and functionality of the various component elements, and will be clear to one of ordinary skill in the art without need for further description with reference to reference designators.

It is further noted that the upper portion of the ball return guide could be further widened or divided into separate openings to facilitate targeting different abdominal muscles by throwing to either side, and in which the ball will be directed to the lower portion regardless of which opening the ball is thrown into. In addition, some form of enclosure or barrier could be implemented to prevent escape of the ball if the opening were to be missed, and which would return the ball to the user without requiring the user to move from the seated position. Other netting or the like could also be provided around the apparatus to prevent loss of the ball if not caught.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention

LIST OF REFERENCE NUMERALS

With regard to reference numerals used, the following numbering is used throughout the drawings

12) present invention
14) user
16) ball
18) ball shoot
20) rebound
22) back
24) backrest
26) buttocks
28) pivotable platform seat
30) feet
32) adjustable feet platform
34) Gas springs
36) ball ramp
40) curved channel portion
42) upper portion
44) lower portion
46) ball return guild
50) side panels
52) vertical supports
54) base
56) ball baffle
58) ball damper
60) ball stop
64) ball rack
68) foot plate
70) pull pin
72) rubber bumber
74) spring mounts
76) seat main frame

What is claimed is:

1. An exercise apparatus comprising:

a seat including a fixed horizontal portion and a backrest hingeably linked to said horizontal portion and movable between an at least partially reclined position and an at least partially upright position; and a ball return guide having a ball reception region and a ball retrieval region such that a ball thrown at said ball reception region thereof is directed from a normal trajectory to a redirected trajectory which leads the ball to said ball retrieval region of the ball return guide, said ball retrieval region located lower than said ball reception region wherein said ball is retrieved by said user, said ball return guide comprising fixed structural members along which said ball moves from said ball reception region to said ball retrieval position, and a rebound member selectively disposable at said ball reception region adapted to rebound a ball thrown thereat.

2. An exercise apparatus according to claim 1, said ball return guide comprising:

a track having a first end in communication with said ball reception region and a second end in communication with said ball retrieval region, wherein a ball thrown into said ball reception region travels along said track to said ball retrieval region.

3. An exercise apparatus according to claim 2, said ball return guide further comprising side walls to substantially prevent a ball thrown into said ball reception region from leaving said track.

4. An exercise apparatus according to claim 1, said ball return guide further comprising side walls to substantially prevent a ball thrown into said ball reception region from leaving said ball return guide other than at said ball retrieval region.

5. An exercise apparatus according to claim 1, said ball return guide further comprising means for slowing a rate of travel of a ball in said ball return guide.

6. An exercise apparatus according to claim 5, said ball slowing means comprising a baffle disposed below an upper portion of said ball return guide, wherein when a ball strikes said baffle, the ball slows down sufficiently so as to be retained in said ball retrieval region.

7. An exercise apparatus according to claim 1, further comprising a stop disposed in said ball retrieval region adapted to substantially prevent a ball from exiting said ball retrieval region.

8. An exercise apparatus according to claim 7, wherein said stop comprises a low wall.

9. An exercise apparatus according to claim 2, wherein said first end of said track is wider than said second end.

10. An exercise apparatus according to claim 1, wherein said ball reception region is larger than said ball retrieval region.

11. An exercise apparatus according to claim 1, further comprising a release pin in communication with said rebound member and adapted to allow a user to selectively move said rebound member away from said ball reception region.

12. An exercise apparatus according to claim 2, said ball return guide further comprising means for slowing a rate of travel of said ball in said track.

13. An exercise apparatus according to claim 1, said ball slowing means comprising a baffle disposed below said first end of said track, wherein when a ball strikes said baffle, the ball slows down sufficiently so as to be retained in said ball retrieval region.

14. An exercise apparatus according to claim 2, further comprising a stop disposed in said ball retrieval region adapted to substantially prevent a ball from exiting said ball retrieval region.

15. An exercise apparatus according to claim 14, wherein said stop comprises a low wall.

16. An exercise apparatus according to claim 1, said track comprising a curved back surface continuous between said first and second ends, wherein said first end is disposed substantially at the top of said apparatus.

17. An exercise apparatus according to claim 1, further comprising a release pin in communication with said rebound member and adapted to allow a user to selectively move said rebound member away from said ball reception area.

18. An exercise apparatus according to claim 2, said ball return guide further comprising side walls to substantially prevent a ball thrown into said ball reception region from leaving said track.

* * * * *